US005729945A

United States Patent [19]

Menchetti et al.

[11] Patent Number: 5,729,945

[45] Date of Patent: Mar. 24, 1998

[54] WALL STRUCTURE AND METHOD OF SECURING FRAMING MEMBERS TO WALLBOARDS WITH AN ADHESIVE

[75] Inventors: Robert J. Menchetti, Buffalo; Matthew J. Kessler, Lancaster, both of N.Y.

[73] Assignee: National Gypsum Company, Charlotte, N.C.

[21] Appl. No.: 422,990

[22] Filed: Apr. 17, 1995

[51] Int. Cl.[6] ..... E04B 2/00

[52] U.S. Cl. ..... 52/481.1; 52/483.1; 52/281; 52/731.1; 52/731.9; 52/733.3; 52/745.09; 52/745.12

[58] Field of Search ..... 52/479, 481.1, 52/483.1, 730.1, 731.1, 731.7–731.9, 733.3, 309.5, 281, 745.05, 745.09, 745.1, 745.12, 745.21, 746.1; 156/71, 91, 305

[56] References Cited

U.S. PATENT DOCUMENTS

| | | | |
|---|---|---|---|
| 1,800,670 | 4/1931 | Venzie . | |
| 2,129,975 | 9/1938 | Urbain . | |
| 2,209,514 | 7/1940 | Drummond | 52/481.1 X |
| 2,881,877 | 4/1959 | Olsen . | |
| 3,217,460 | 11/1965 | Downing, Jr. . | |
| 3,229,435 | 1/1966 | Olsen . | |
| 3,271,920 | 9/1966 | Downing, Jr. . | |
| 3,276,180 | 10/1966 | Westinghouse . | |
| 3,333,390 | 8/1967 | Banning . | |
| 3,357,148 | 12/1967 | Turner . | |
| 3,533,205 | 10/1970 | Pestel et al. . | |
| 3,712,015 | 1/1973 | Nelson . | |
| 3,778,939 | 12/1973 | Nelsson . | |
| 3,839,839 | 10/1974 | Tillisch et al. . | |
| 3,859,765 | 1/1975 | Nelsson | 52/424 X |
| 3,921,346 | 11/1975 | Sauer et al. . | |
| 3,940,899 | 3/1976 | Balinski . | |
| 3,943,680 | 3/1976 | Balinski . | |
| 4,047,355 | 9/1977 | Knorr . | |
| 4,069,640 | 1/1978 | Dawdy | 52/481.1 X |
| 4,112,636 | 9/1978 | Hays . | |
| 4,149,353 | 4/1979 | Adams . | |
| 4,152,873 | 5/1979 | Burke | 52/733.3 X |
| 4,152,878 | 5/1979 | Balinski . | |
| 4,194,336 | 3/1980 | Weinar . | |
| 4,289,554 | 9/1981 | Reicherts et al. . | |
| 4,296,580 | 10/1981 | Weinar . | |
| 4,324,082 | 4/1982 | Rutkowski et al. . | |
| 4,333,286 | 6/1982 | Weinar . | |
| 4,353,192 | 10/1982 | Pearson et al. . | |
| 4,364,212 | 12/1982 | Pearson et al. . | |
| 4,435,936 | 3/1984 | Rutkowski . | |
| 4,467,578 | 8/1984 | Weinar . | |
| 4,471,593 | 9/1984 | Ragland . | |
| 4,489,529 | 12/1984 | Ollinger et al. | 52/731.7 |
| 4,531,338 | 7/1985 | Donatt | 52/745.21 X |
| 4,567,706 | 2/1986 | Wendt . | |
| 4,621,473 | 11/1986 | Wendt . | |
| 4,635,423 | 1/1987 | Ward | 156/71 X |
| 4,748,781 | 6/1988 | Wencley | 52/309.5 |
| 4,831,808 | 5/1989 | Wynar . | |
| 4,866,899 | 9/1989 | Houser . | |
| 4,914,883 | 4/1990 | Wencley | 52/309.5 |
| 5,425,908 | 6/1995 | Merser | 52/309.5 X |

*Primary Examiner*—Robert Canfield

*Attorney, Agent, or Firm*—Marshall, O'Toole, Gerstein, Murray & Borun

[57] ABSTRACT

This disclosure relates to a wall construction including an outer panel and an inner panel, the inner panel being formed by at least one wallboard. The outer and inner panels are substantially parallel and are spaced apart to form an interior space between them. Within the interior space and secured to the outer and inner panels are one or more framing members made of roll formed sheet metal. Each framing member comprises a web which extends between and is substantially perpendicular to the outer and inner panels. At an outer portion of the member is formed an outer flange which abuts and is secured to the outer panel. At an inner portion of the framing member is formed at least one tab which extends closely adjacent the inner panel and at least one cutout formed in the member. An adhesive secures the inner portion including the tab to the inner panel. The framing member may further include a clip which extends through the cutout and is attached to the panel.

30 Claims, 17 Drawing Sheets

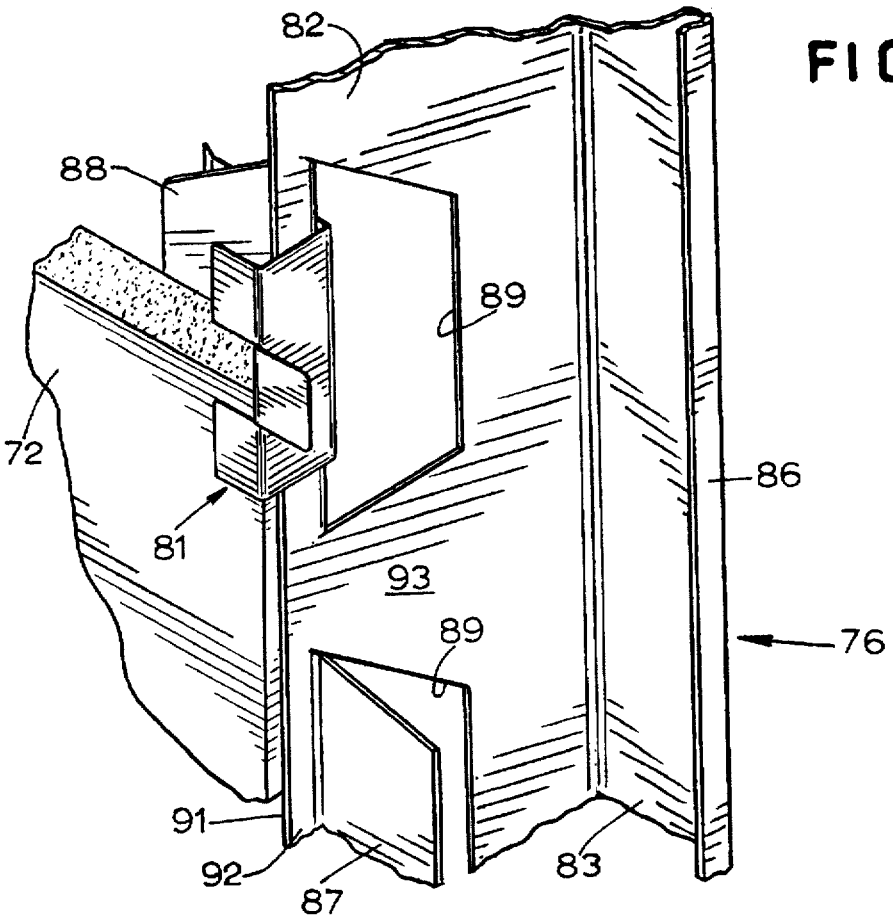
FIG. 2
FIG. 3
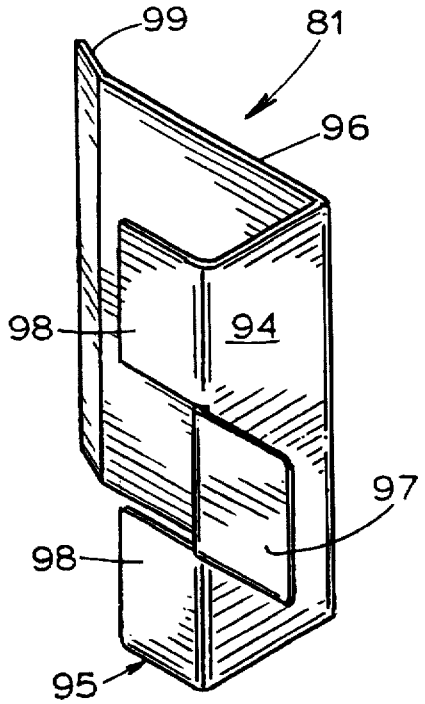

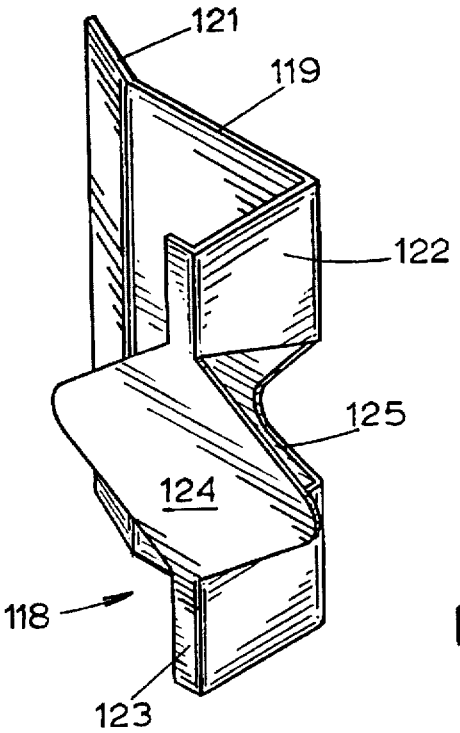
FIG. 5
FIG. 6
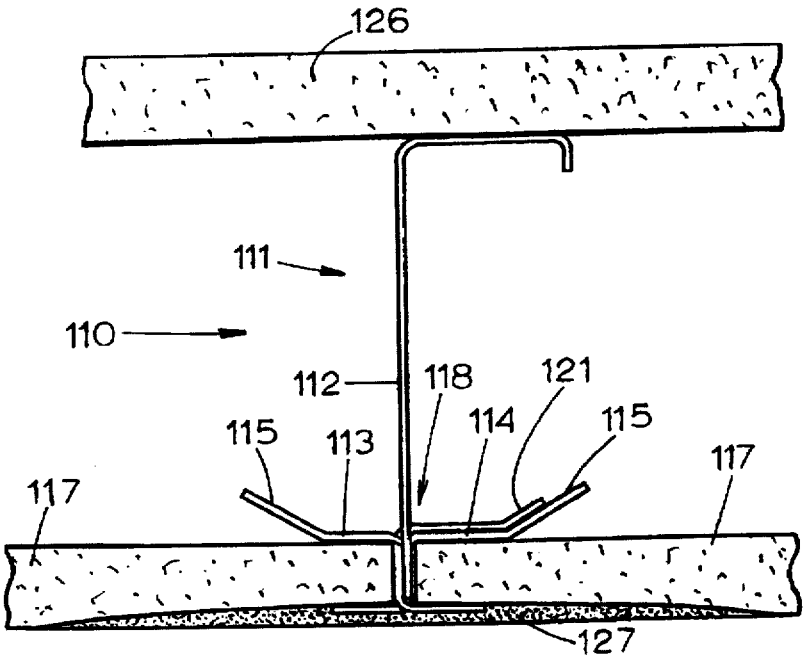

WALL STRUCTURE AND METHOD OF SECURING FRAMING MEMBERS TO WALLBOARDS WITH AN ADHESIVE

FIELD AND BACKGROUND OF THE INVENTION

This invention relates to a framing member for a wall structure and to a method of securing such a framing member to wallboards.

Most buildings (such as residential, commercial and manufactured housing) include hollow walls formed by an outer sheet or panel, interior sheets or panels such as gypsum wallboard, and framing members (such as studs) separating and connecting the outer and interior panels. The framing members support and separate the panels and form a hollow space between them.

FIG. 30 and 31 herein show examples of conventional structures of this nature. In FIG. 30, a hollow wall 50 is formed by an outer panel 51, at least one framing member or stud 52 which extends vertically of the wall, and two interior sheets 53 and 54 of gypsum wallboard. The member 52 includes an outer side 56 which is secured to the panel 51 by a fastener (not shown) such as nails, screws and/or an adhesive. A joint 57 between the two panels 53 and 54 overlies the inner side 58 of the member 52, and the panels are secured to the member 52 by a fastener such as an adhesive 59 and/or nails and screws (not shown). A joint tape 61 and joint compound 62 are usually provided to cover the joint 57.

FIG. 31 shows a similar wall including at least one roll-formed metal C-channel 63 which forms the framing member. The channel 63 includes an outer flange 64 secured to an outer panel 65 and an inner flange 66 secured by an adhesive 67 to sheets 68 of wallboard.

Walls of this type are also described in numerous prior art patents. U.S. Pat. No. 3,271,920, for example, describes metal studs having points for attaching wallboards to the studs. U.S. Pat. No. 4,866,899 shows a metal stud wherein tabs are bent out of a web. The following listed U.S. patents also show examples of such wall structures:

| NUMBER | DATE |
|---|---|
| 1,800,670 | 04/14/31 |
| 2,129,975 | 09/13/38 |
| 2,881,877 | 04/14/59 |
| 3,217,460 | 11/16/65 |
| 3,229,435 | 01/18/66 |
| 3,276,180 | 10/04/66 |
| 3,357,148 | 12/12/67 |
| 3,533,205 | 10/13/70 |
| 3,712,015 | 01/23/73 |
| 3,778,939 | 12/18/73 |
| 3,839,839 | 10/08/74 |
| 3,921,346 | 11/25/75 |
| 3,940,899 | 03/02/76 |
| 3,943,680 | 03/16/76 |
| 4,047,355 | 09/13/77 |
| 4,112,636 | 09/12/78 |
| 4,149,353 | 04/17/79 |
| 4,152,878 | 05/08/79 |
| 4,194,336 | 03/25/80 |
| 4,296,580 | 10/27/81 |
| 4,333,286 | 06/08/82 |
| 4,353,192 | 10/12/82 |
| 4,364,212 | 12/21/82 |
| 4,435,936 | 03/13/84 |
| 4,467,578 | 08/28/84 |
| 4,471,593 | 09/18/84 |

-continued

| NUMBER | DATE |
|---|---|
| 4,567,706 | 02/04/86 |
| 4,621,473 | 11/11/86 |
| 4,831,808 | 05/23/89 |
| 4,866,899 | 09/19/89 |
| 4,324,082 | 04/13/82 |

While prior art structures may serve their intended purpose, there is a continuing need for an efficient, cost-effective method of constructing a hollow wall and for metal framing members requiring less material (and therefore are less costly). While this need is true for most structures such as residential and commercial buildings, it is particularly true for relatively low cost structures such as manufactured housing.

It is therefore a general object of the present invention to provide an improved framing member, a method of securing such a framing member to wallboards, and a wall including such a framing member.

SUMMARY OF THE INVENTION

A wall constructed in accordance with this invention comprises an outer panel and an inner panel, the inner panel being formed by at least one wallboard. The outer and inner panels are substantially parallel and are spaced apart to form an interior space between them. Within the interior space and secured to the outer and inner panels are one or more framing members made of roll formed sheet metal. Each framing member comprises a web which extends between and is substantially perpendicular to the outer and inner panels. At an outer portion of the member is formed an outer flange which abuts and is secured to the outer panel. At an inner portion of the framing member is formed at least one tab which extends closely adjacent the inner panel and at least one cutout formed in the member. An adhesive secures the inner portion including the tab to the inner panel. The framing member may further include a clip which extends through the cutout and is attached to the panel.

BRIEF DESCRIPTION OF THE DRAWINGS

This invention will be better understood from the following detailed description taken in conjunction with the accompanying figures of the drawings wherein:

FIG. 2 is an enlarged fragmentary view of a portion of the wall and the framing member;

FIG. 3 is a perspective view of a clip of the framing member;

FIGS. 5 and 6 are views similar to FIGS. 3 and 4D but showing an alternative construction of the clip;

DETAILED DESCRIPTION OF THE INVENTION

Figure 1:
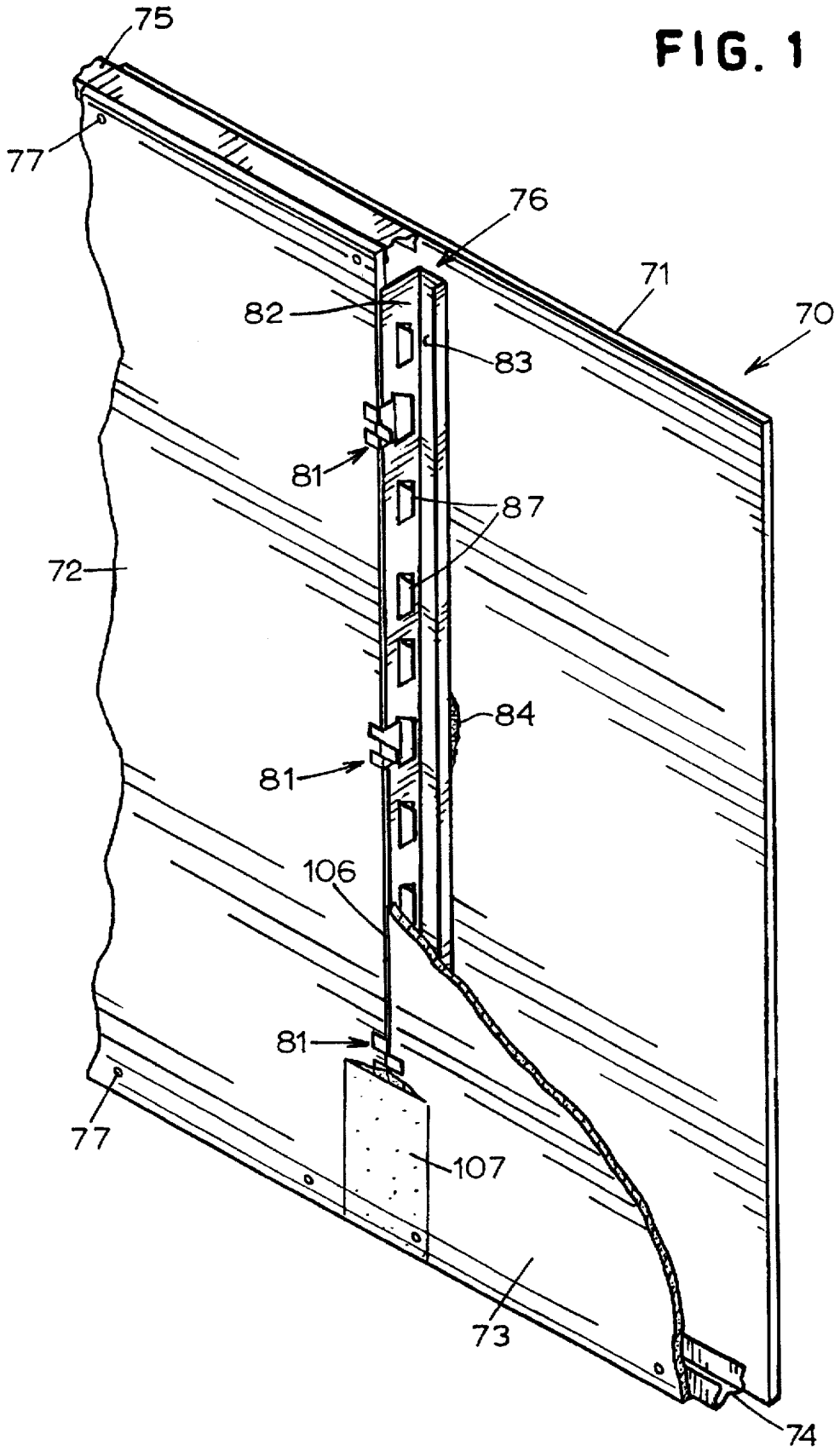
FIG. 1 is a fragmentary perspective view of a wall including a framing member, constructed in accordance with the present invention.

With reference first to FIG. 1, a wall 70 is formed by an outer panel 71, interior panels 72 and 73 such as gypsum wallboard, a floor track 74, a ceiling track 75, and one or more framing members 76. The floor track 74 includes a horizontally extending web which is secured to a floor (not illustrated) by suitable fasteners, and the ceiling track 75 is parallel to the floor track and is similarly secured to a ceiling (not illustrated) by suitable fasteners. The ceiling and floor tracks include vertically extending flanges, and the outer and inner panels are secured along their top and bottom edges to the flanges of the tracks 75 and 74 by conventional fasteners 77 such as screws. The outer panel 71 is parallel with the inner panels 72 and 73 and spaced from them to form a hollow interior space. The framing member 76 extends vertically between the floor and ceiling tracks and is mounted within the interior space between the outer panel 71 and the inner panels 72 and 73.

The framing member 76 is better illustrated in FIG. 2 and optionally includes a clip 81 best shown in FIG. 3. The member 76 includes a web 82 which extends perpendicularly of the panels 71–73. At an outer portion of the member 76 is formed an outer flange 83 which is perpendicular to the web 82 and is secured to the outer panel 71. While the panel 71 may be secured to the flange 83 by fasteners, in the present instance an adhesive 84 (FIG. 1) is shown securing the panel 71 to the framing member. At an edge of the outer flange 83 is formed a lip 86 which is turned toward the inner panels and is provided to stiffen the flange 83.

The inner portion of the member 76 is secured to the inner panels 72 and 73, and to this end a plurality of tabs 87, 88 and 92 are formed along the length of the inner portion of the member 76. The tabs 87 and 88 extend alternately in opposite directions laterally from the web 82 and are formed by punching out portions of the web 82, thereby leaving the web openings 89. The back tabs 87 and 88 are spaced a short distance from the inner edge 91 of the web 82, thereby forming an edge tab; in the instances where the edge tab extends into a joint between two boards, it is referred to herein as a joint tab. The joint tab 92 is between the edge 91 and the inner surfaces of the tabs 87 and 88. The tabs 87 and 88 and the openings 89 are spaced apart longitudinally of the web 82, thereby leaving web supporting portions 93 between the openings 89. The joint tab 92 extends the length of the member 76.

With reference to FIG. 3, the optional clip 81 comprises a web portion 94, and a back flange 96 and a front flange 95. The front and back flanges 95 and 96 extend parallel to each other and perpendicular to the web 94, the flanges 95 and 96 being spaced apart a distance substantially equal to the thickness of the edge portions of the inner panels 72 and 73. A center portion of the front flange 95 is cut and folded in the reverse direction to form a retaining tab 97, thereby leaving two retaining tabs 98 extending in the opposite direction from the retaining tab 97. The outer flange 96 forms a back leg, and the end edge portion 99 of the back flange 96 is preferably bent outwardly away from the front flange 95 to facilitate assembly of the parts as will be described. The width of the web 94 (the width being in the vertical direction as seen in FIGS. 2 and 3) is less than the vertical width of the web openings 89 so that the clip may be inserted through an opening 89 as shown in FIG. 2.

Figure 4A:
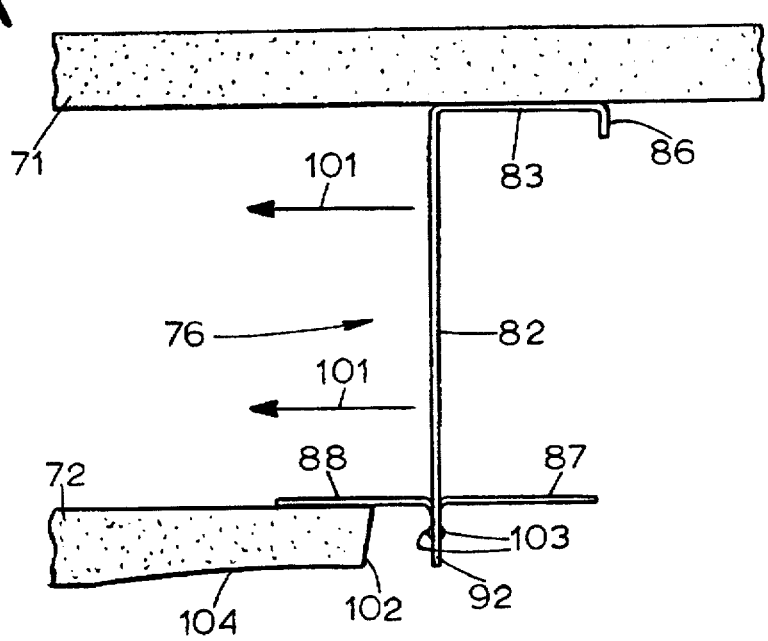
FIGS. 4A through 4D illustrates steps in the construction of the wall shown in FIGS. 1–3.

FIGS. 4A through 4D illustrate steps in the method of assembling the wall 70 in the instance where clips 81 are provided. Assume that the back panel 71 and the front 72 are in place and are secured to the floor and ceiling tracks 74 and 75, the framing member 76 is positioned with the outer flange 88 against the inner surface of the outer panel 71, and the back tabs 88 positioned against the interior surface of the panel 72, as shown in FIG. 4A. The framing member 76 is then slid in the direction of the arrows 101 in FIG. 4A with the back tabs 88 closely adjacent the interior surface of the panel 72, until the joint tab 92 engages the end edge 102 of the panel 72. If desired, dimples 103 (FIGS. 4A and 4B) may be formed on the tab 92 to ensure proper engagement between the tab 92 and the edge 102. It will be noted from FIGS. 4A through 4D that, in this specific example of the invention, shallow depressions indicated generally by the numeral 104 are formed adjacent the vertical edges 102 of the two panels 72 and 73, and that the horizontal length of the tab 92 is substantially the same as or slightly shorter than the thickness of the edges 102.

Figure 4B:
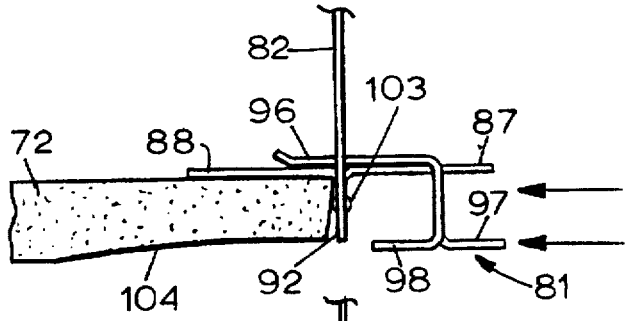
Figure 4C:
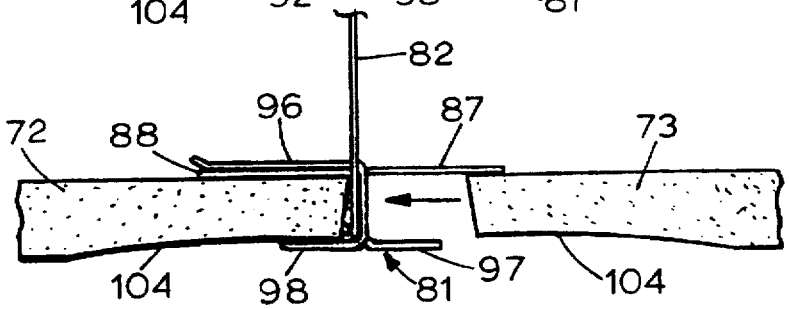
Figure 4D:
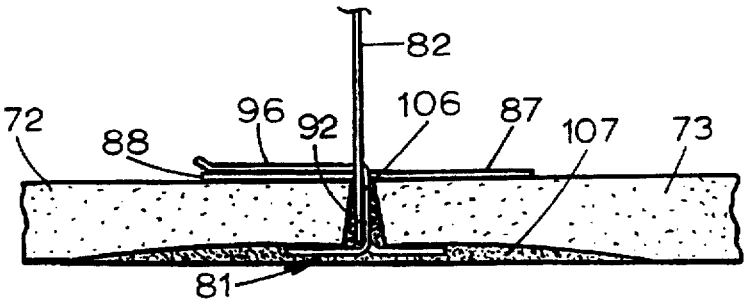
Figure 7:
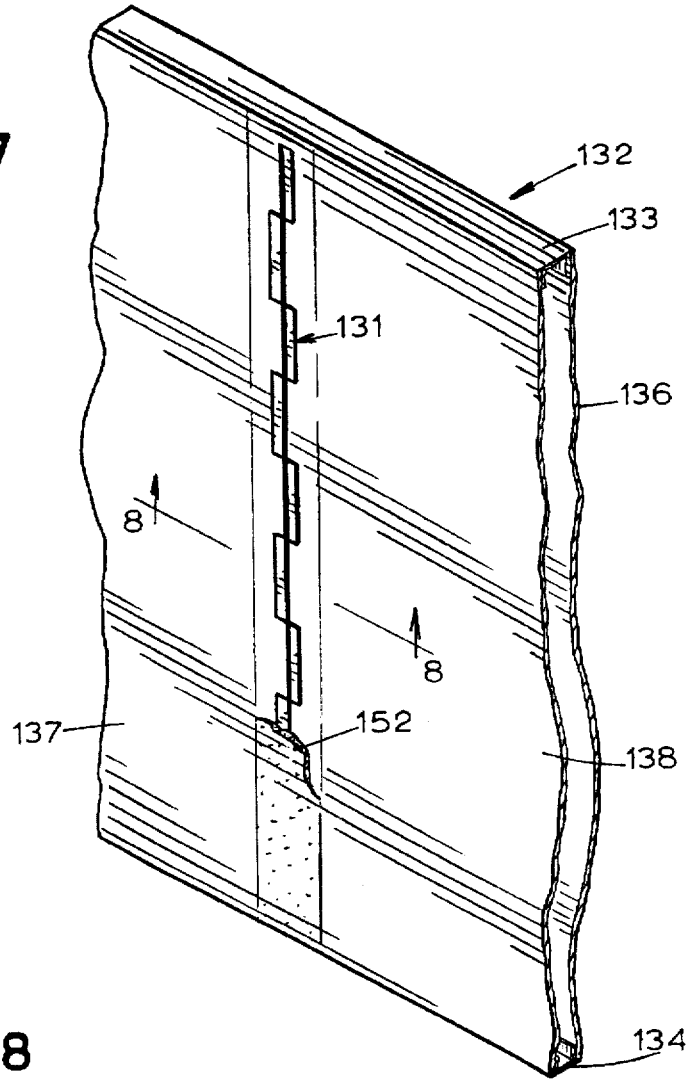
FIG. 7 is a perspective view of another embodiment of a wall incorporating the invention.

With the framing member 76 secured as by an adhesive or screws to the panel 71, at least one clip 81 is positioned with the back leg 96 extending through an opening 89 in the web 82 as shown in FIG. 4B and it is slid toward the left as seen in FIG. 4B, causing the back leg 96 to slide over the tab 88 and the retaining tabs 98 to slide over the innermost surface of the panel 72 as illustrated in FIG. 4C. The other inner panel 73 is then slid into position between the tabs 87 and the tab 97 of the clip 81 as illustrated in FIGS. 4C and 4D.

The tabs 87 and 88 are spaced from the tabs 97 and 98 such that the tabs hold the edges of the panels 72 and 73.

The outer flange 83 of the framing member is secured to the back panel by the adhesive 84 and/or by screws as previously mentioned, and the adhesive 84 may be applied either before or after the framing 76 is in the position illustrated in FIG. 4A and 4B. After the panel 73 is in place as shown in FIG. 4D, it is secured to the floor and ceiling tracks utilizing the fasteners 77, and then an adhesive 107 is applied to cover the joint 106 between the two panels 72 and 73. The adhesive 107 may be a hard bond type of joint compound which fills the depressions 104 and the joint 106 between the panels 72 and 73, and it firmly secures the tabs 97 and 98, as well as the tab 92, to the panels 72 and 73. The back tabs 87 and 88 which are behind the panel 72 and 73 form supports or stops which support the panel 72 and 73 along the joint.

The structure shown in FIGS. 5 and 6 is generally similar to that shown in FIGS. 1 through 4 but with a clip having a different shape.

FIG. 6 shows a wall 110 with a modified framing member 111, including a part 112 having tabs 113 and 114 which are generally similar to the tabs 87 and 88 illustrated in FIG. 2. However, the outer end portions 115 are bent upwardly (as seen in FIG. 6) to facilitate assembly of the framing member 111 with the inner panels 117. The framing member 111 further includes a clip 118 which is generally similar to the clip 81 illustrated in FIG. 3. The clip 118 includes a back leg 119 having an angled edge portion 121, a web 122, and a leg 123 that extends generally parallel to the back leg 119. A tab 124 extends in opposite directions from the leg 123, and at least part of the tab 124 is punched out of the web 122 and the back legs 119 leaving an opening 125. With reference to FIG. 6, one or more of the clips 118 is assembled with the part 112 by inserting the back leg 119 through openings in the part 112. The openings are formed when the tabs 113 and 114 are punched out as previously described. The tabs 124 extend along the front faces of the panels 117 and the tabs 113 and 114 extend against the back faces of the panels 117. The member 111 is also secured, of course, to the back or outer panel 126 of the wall 110, and a hard bond type of adhesive or joint compound 127 is applied over the joint between the two panels 117 and into the joint and around the tabs 124. The compound 127 may also extend into the opening 125 and down to the outer surface of the tabs 124 in order to more firmly secure the clip 118 to the panels 117. The portions of the leg 123 at the opposite sides of the tabs 124 also extend over the interior surface of one of the two panels 117.

FIGS. 7 through 10 illustrate another framing member 131 for a wall 132. Again, the wall 132 includes ceiling and floor tracks 133 and 134, an outer panel 136, and two inner panels 137 and 138. The inner and outer panels are secured by fasteners to the upper and lower tracks as described in connection with FIG. 1. The framing member 131 extends between the outer and inner panels and has a length slightly less than the vertical distance between the floor and ceiling tracks so that the framing member 131 stops short of the tracks.

Figure 9:
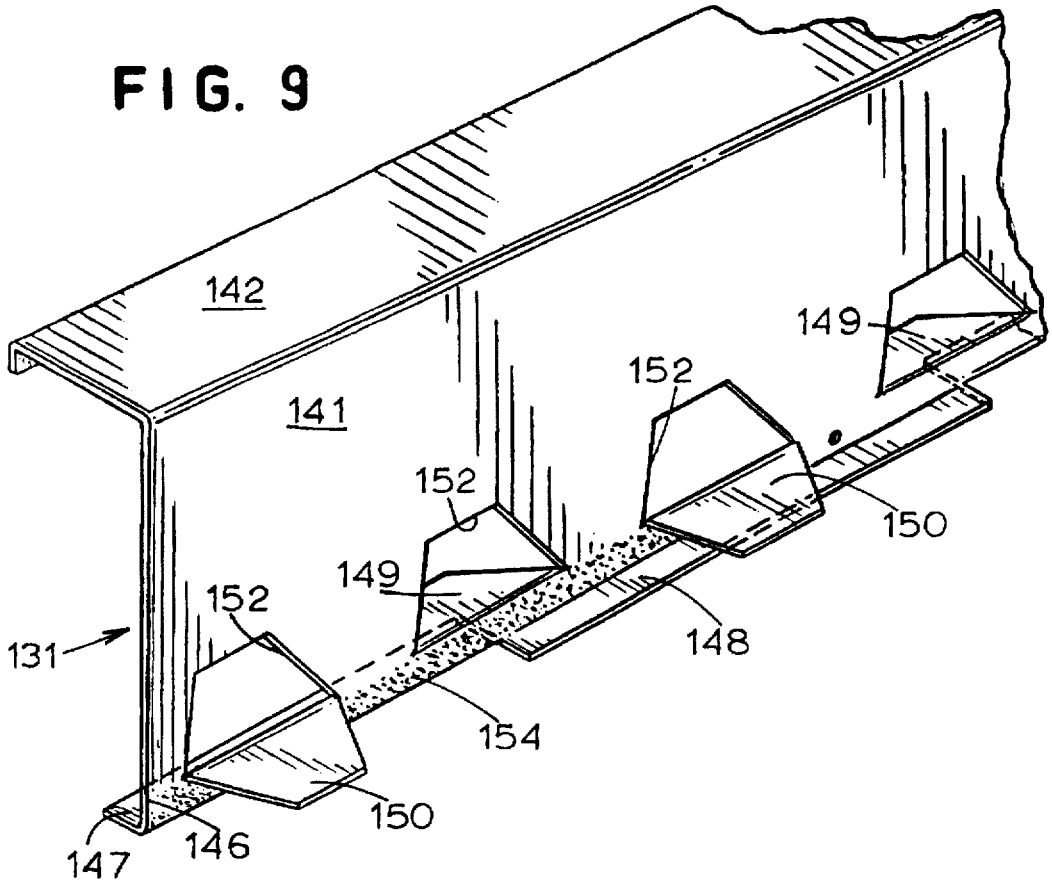
FIG. 9 is a perspective view of a framing member of the wall shown in FIG. 7.
Figure 10:
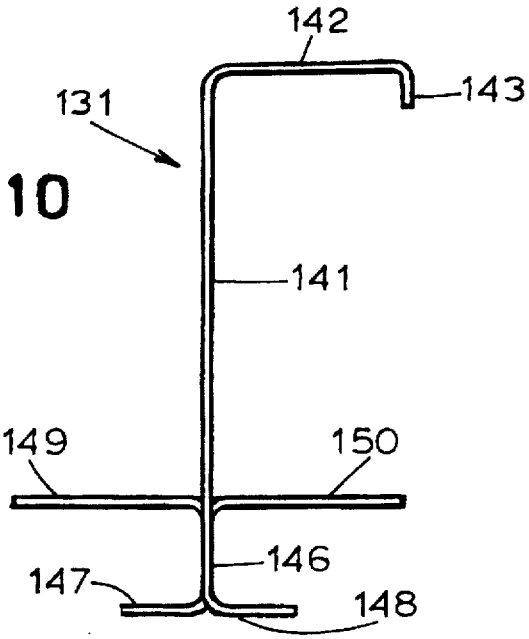
FIG. 10 is an end view of the framing member of FIG. 9.

With specific reference to FIGS. 9 and 10, the framing member 131 comprises a web 141, an outer flange 142 (having an inwardly extending leg 143 at its outer end), and tabs formed at its end which is adjacent to the inner panels 137 and 138. The tabs include a joint tab 146 which is a continuation of the web 141, and inner tabs 147 and 148 which extend alternately in opposite directions from the inner end of the joint tab 146 (see FIG. 9). The tabs further include a plurality of spaced apart back tabs 149 and 150 which also extend alternately in opposite directions from the web 141. The tabs 149 and 150 are punched out of the web 141, thereby leaving spaced apart web openings 152 in the web 141. As illustrated in FIG. 9, the inner tabs 148 are substantially longer (in the lengthwise direction of the member 131) than the back tabs 149 and 150 and the spaces between them. In the example illustrated in FIG. 9, each of tabs 147 and 148 extends from substantially the midpoint of one of the tabs 149, past the other tab 150 and to substantially the midpoint of the next adjacent tab 149.

Figure 8:
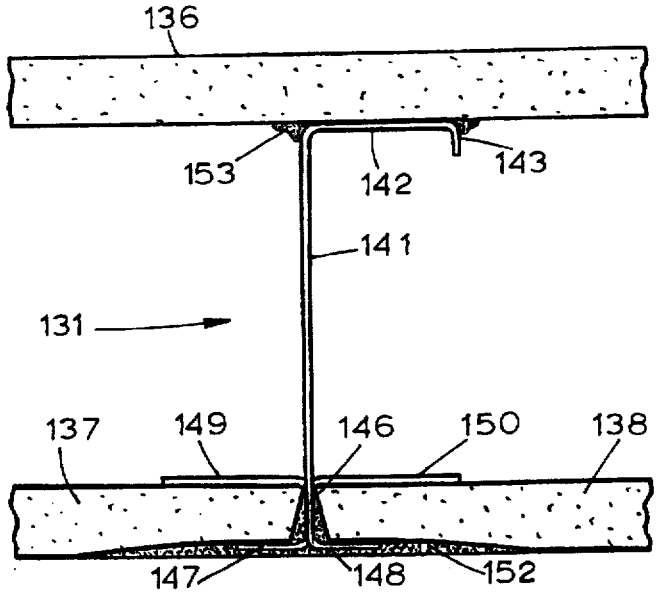
FIG. 8 is a sectional view taken on the line 8—8 of FIG. 7.

With reference to FIG. 8, the wall is assembled by securing the outer panel 136 and the inner panel 137 in place on the floor and ceiling tracks and then sliding the structural member 131 into place with the tabs 147 and 149 overlying the front and back sides of the edge portion of the panel 137. An adhesive 153 is provided to secure the flange 142 to the outer panel 136. The edge portion of the other inner panel 138 is then positioned in the opening formed between the tabs 148 and the tabs 150. A high strength type of joint compound 152 (FIGS. 7 and 8) is then applied over the joint between the two inner panels 137 and 138, and the compound covers the joint tab 146 and the two front tabs 147 and 148, thereby firmly securing the inner panels 137 and 138 to the framing member 131. The sides of the joint tab 146 may be roughened as indicated by the numeral 154 to increase the bond between the joint compound and the framing member 131.

Figure 11:
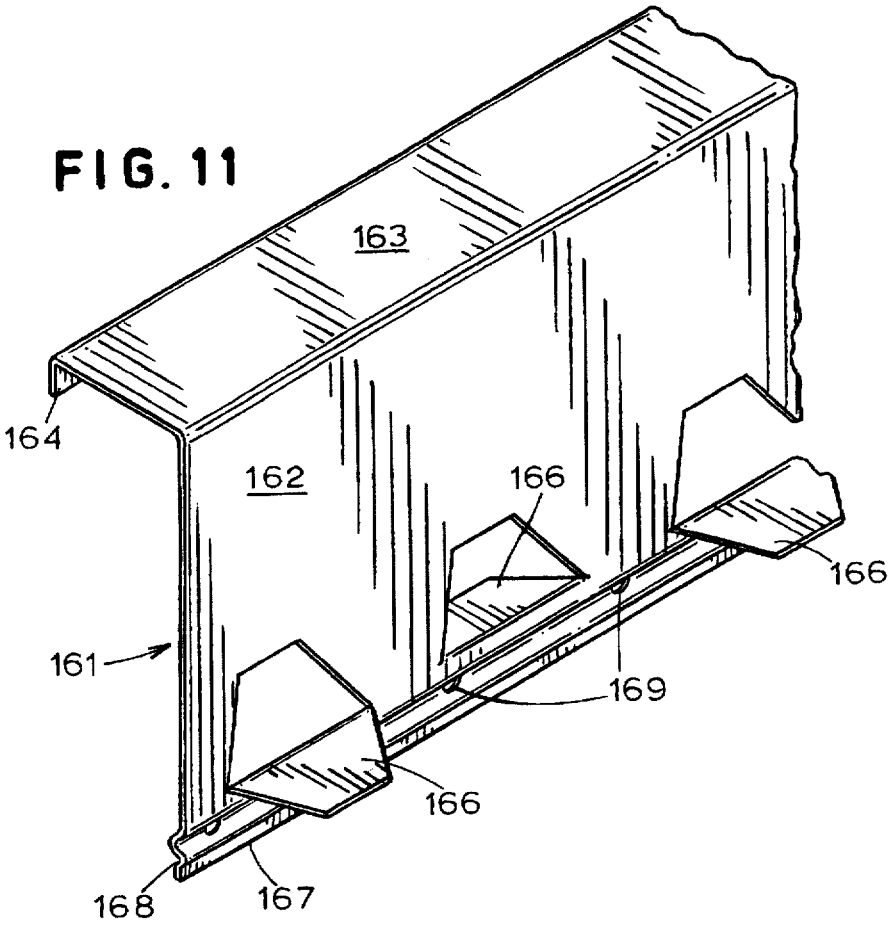
FIG. 11 is a perspective view of another embodiment of the framing member.
Figure 12:
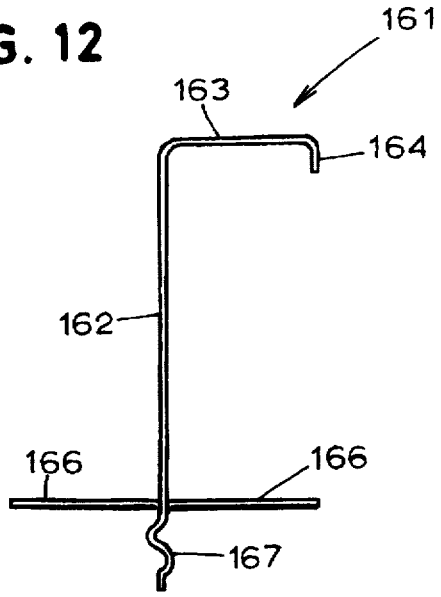
FIG. 12 is an end view of the framing member shown in FIG. 11.
Figure 13:
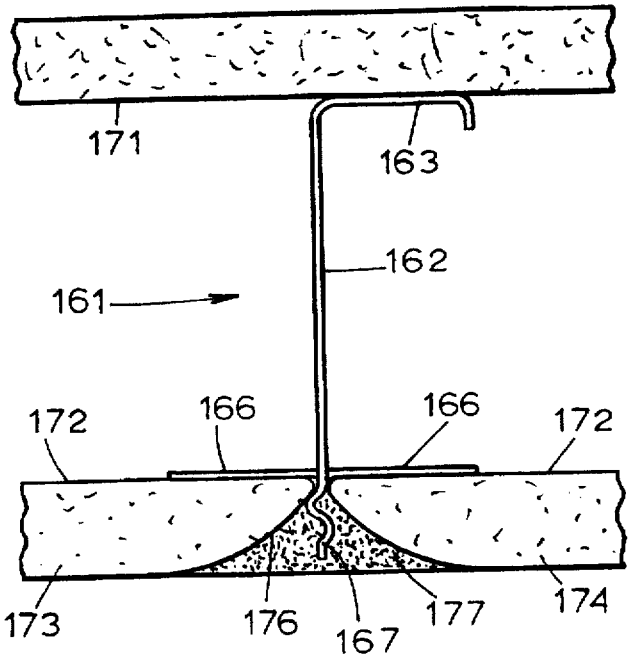
FIG. 13 is a sectional view of a wall including the framing member shown in FIGS. 11 and 12.

FIGS. 11 through 13 illustrate the construction of another framing member 161 which includes a web 162, an outer flange 163 including a lip 164, and tabs formed along the inner edge portion of the web 162. The tabs include a plurality of longitudinally spaced back tabs 166 which extend alternately in opposite directions from the web 162, and a joint tab 167 which extends essentially the length of the web 162. In the embodiment of the invention illustrated in FIGS. 11 through 13, the joint tab 167 is bent to form curved portions 168, and a series of holes 169 are formed through the joint tab 167.

With reference to FIG. 13, the outer flange 163 is secured as by a adhesive (not shown in FIG. 13) to an outer panel 171, and the back tabs 166 engage the outer surfaces 172 of two inner panels 173 and 174. The joint tab 167 extends into the joint space 176 between the two panels 173 and 174, and an adhesive or joint compound 177 fills the joint space 176. The compound 177 covers the joint and the joint tab 167 and firmly secures the panels 173 and 174 to the framing member 161. The compound 177 fills the arcuate spaces of the curved portion 168 and extends through the holes 169 in order to enhance the joint between the inner panels and the framing member 161.

In the wall shown in FIG. 13, as well as in the other embodiments disclosed herein, the back tabs 166 form stops which support and hold the panels 173 and 174 spaced from the outer panel 171.

Figure 14:
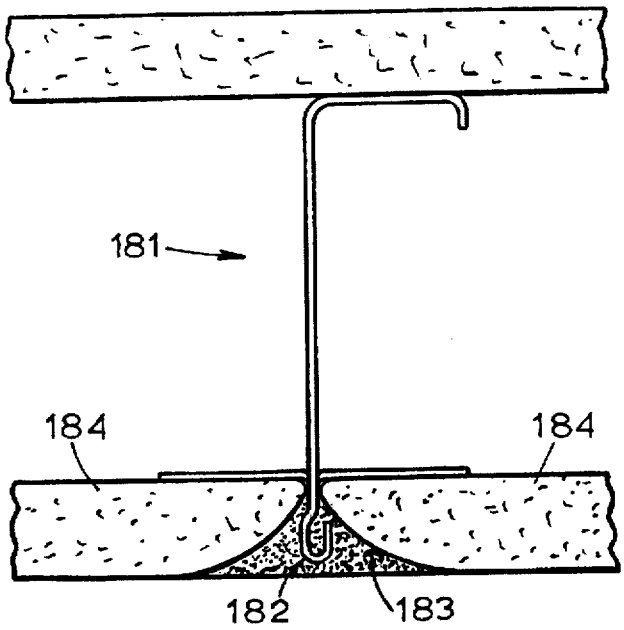
FIG. 14 is a view similar to FIG. 13 but showing another embodiment of the framing member.

FIG. 14 illustrates a framing member 181 which is generally similar in construction to that of the framing member 161. The difference is that, instead of a joint tab having curved portions 168 as illustrated in FIGS. 11 through 13, the framing member 181 includes a joint tab 182 that has the shape of a hook and that extends essentially the full length of the framing member. A joint compound 183 fills the joint between two inner panels 184 and fills the interior hook space in order to firmly secure the panels 184 to the framing member 181.

Figure 15A:
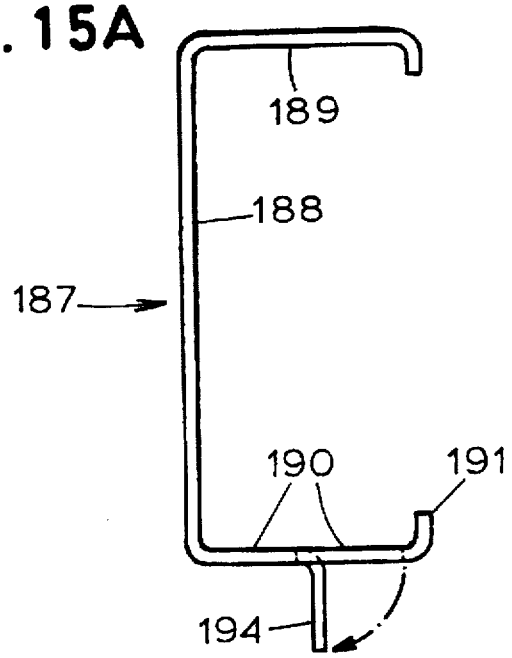
FIG. 15A is an end view of another embodiment of the framing member.
Figure 15B:
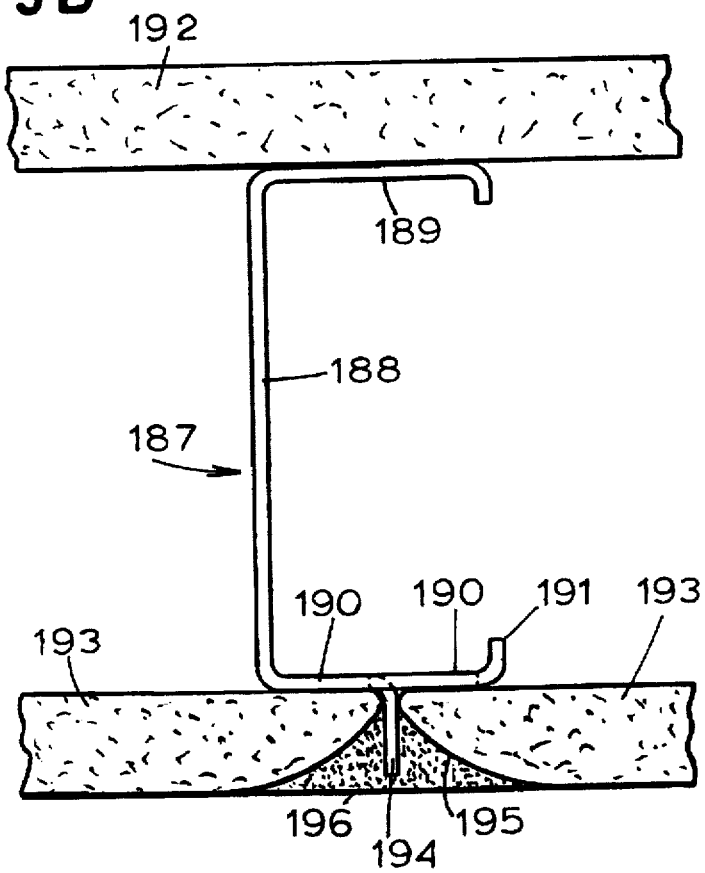
FIG. 15B is a sectional view of a wall including the framing member shown in FIG. 15A.

FIGS. 15A and 15B illustrate a framing member 187 having the general shape of a C-channel, the member 187 including a web 188, an outer flange 189 and an inner flange 191. The outer flange 189 is secured as by an adhesive (not shown) to an outer panel 192 (FIG. 15B), and the inner flange 191 forms back tabs 190 which are engaged by the outer surfaces of two inner panels 193. At spaced locations, along the length of the flange 191, joint tabs 194 are punched out of the flange 191, the tabs 194 extending substantially perpendicular to the back tabs 190. The joint tabs extend into the joint 195 between the edges of the two inner panels 193. The joint 195 is filled with a joint compound 196 which surrounds and adheres to the joint flange 194 and the adjacent edges of the two panels 193. As shown in FIG. 15B, the adjacent edges of the panels 193 are curved in order to provide a large space for the joint compound 196 and the joint tab 194. The sides of the joint tab 194 may be roughened or have holes formed therein in order to increase the adherence of the joint compound 196 to the joint tab 194.

Figure 16:
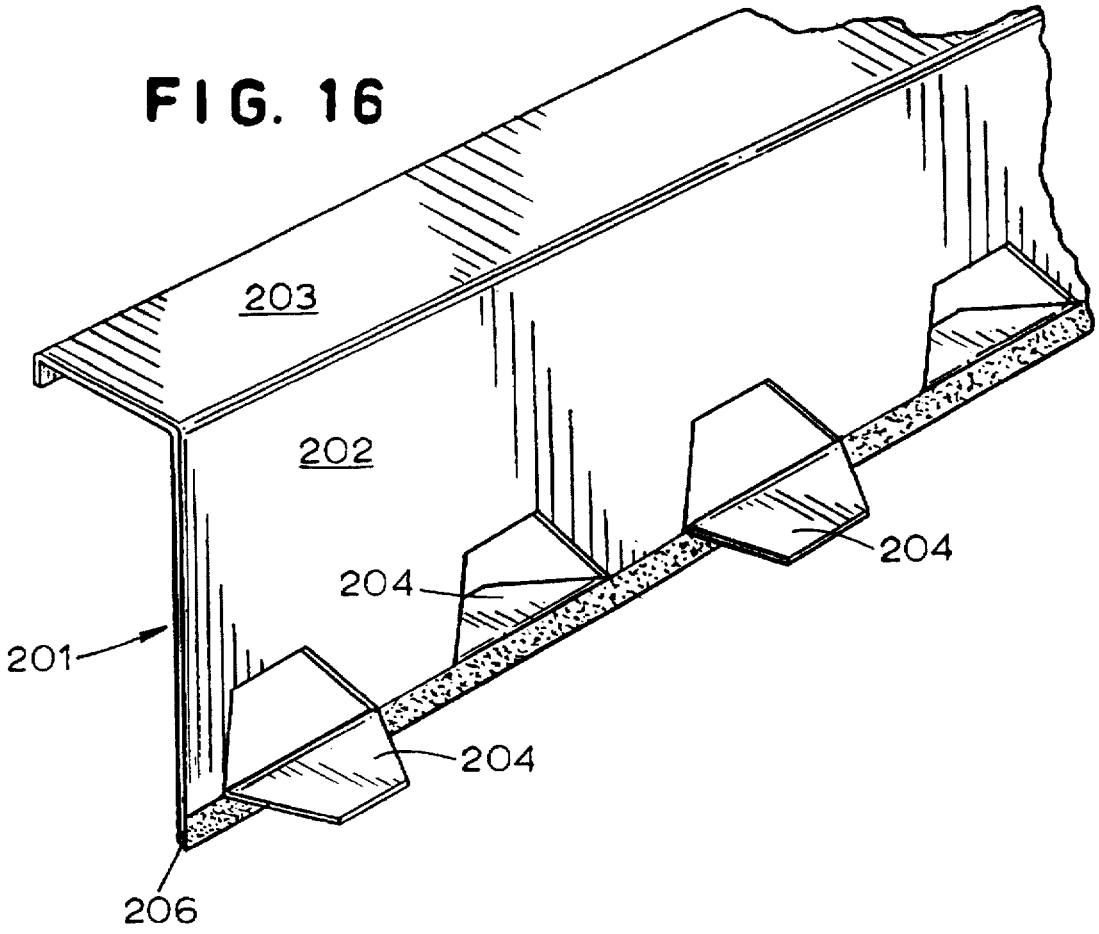
FIG. 16 is a perspective view of still another embodiment of the framing member.
Figure 17:
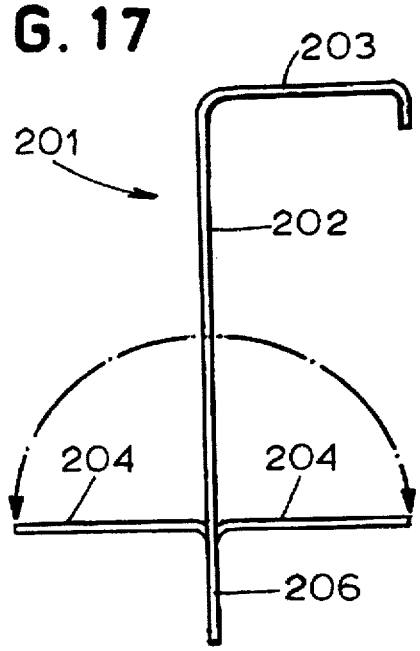
FIG. 17 is an end view of the framing member shown in FIG. 16.
Figure 18:
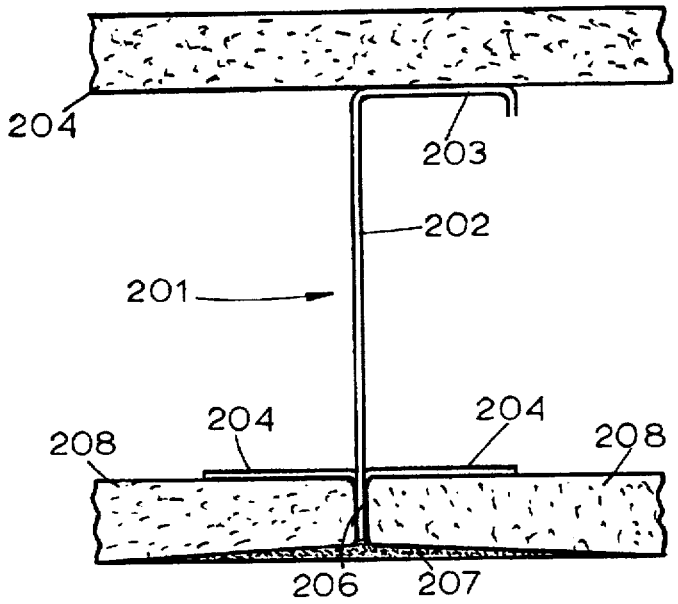
FIG. 18 is a sectional view of a wall including the framing member shown in FIGS. 16 and 17.

FIGS. 16, 17 and 18 illustrate a framing member 201 having the general shape of the framing member 80 illustrated in FIGS. 2 and 4A to 4D. The framing member 201 includes a web 202, an outer flange 203, a plurality of oppositely extending, spaced apart, back tabs 204, and a joint tab 206. The joint tab 206 may be roughened as illustrated in FIG. 16 in order to increase the adherence between a joint compound 207 (FIG. 18) and the adjacent edges of the inner panels, and holes (not illustrated in FIG. 16) may also be formed through the joint tab 206. With reference to FIG. 18, the joint tab 206 is positioned in the joint between two inner panels 208, and the outer flange 203 is secured to an outer panel 204 as by an adhesive (not illustrated in FIG. 18). The joint compound 207 binds or secures the joint tab 206 to the panels 208.

Figure 19:
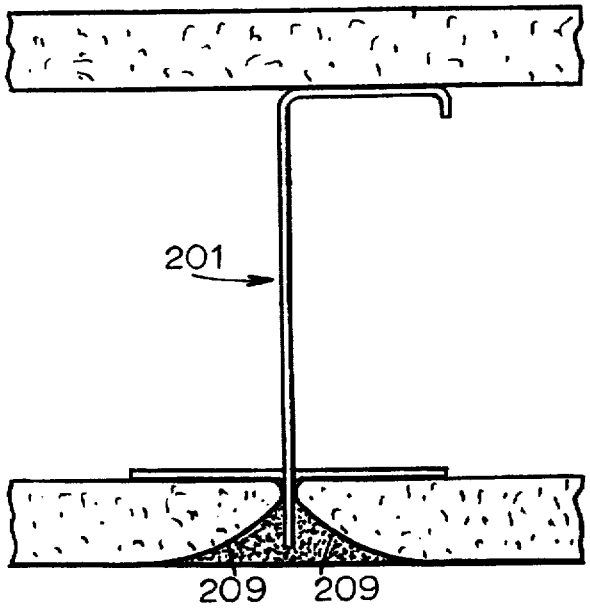
FIG. 19 is a view similar to FIG. 18 but showing another embodiment of the wall.

FIG. 18 illustrates two panels wherein the edges adjacent the joint are depressed slightly in order to receive the joint compound, and FIG. 19 which illustrates the same structural member 201 but in a panel construction wherein the joint edges 209 are curved to create a larger space for the joint compound.

The framing member 201 has an advantageous construction in that it is relatively economical and easy to manufacture and to assemble with the wall panels. The back tabs 204 are punched out of the web 202 and therefore do not require added metal at the inner portion of the member. Since the tabs 204 are discontinuous (that is, they are spaced apart along the length of the member), and since the joint tab 206 is continuous along the inner side of the openings punched out of the web, the web is not materially weakened by the formation of the back tabs 204. Still further, additional tabs or a flange along the inner edge of the joint tab 206 are not required because the joint tab is secured to the boards by the joint compound.

Figure 21:
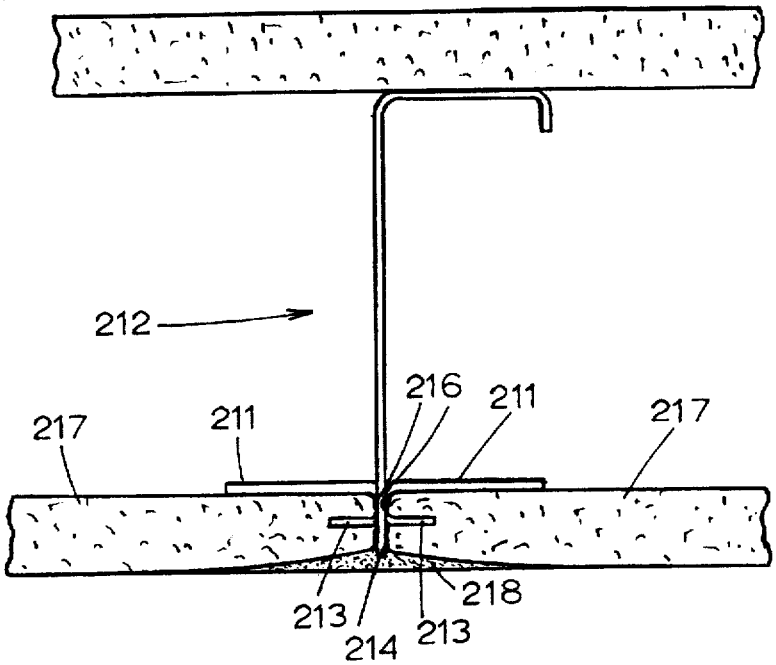
FIG. 21 is a sectional view of a wall including the framing member shown in FIG. 20.
Figure 20:
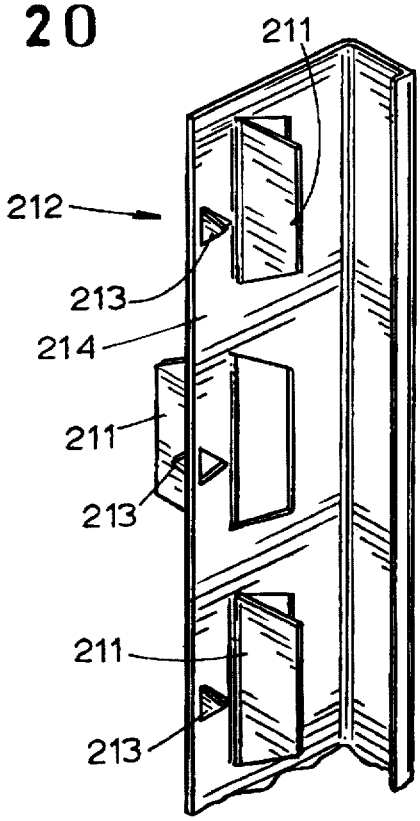
FIG. 20 is a perspective view of still another embodiment of the framing member.

FIGS. 20 and 21 illustrate a framing member 212 having a shape similar to that of the member 201. In addition to an outer flange, a web, and back tabs 211, the framing member 212 also includes points 213 formed on the joint tab 214. As better shown in FIG. 20, the points 213 are triangular in shape and have relatively sharp, pointed apexes, and they extend alternately in opposite directions from the joint tab 214. When assembling a wall including the structural member 212, the points 213 are pressed into the adjacent edges 216 of the inner panels 217, thereby forming a mechanical joint between the joint tab 214 and the panels 217. Once again, a joint compound 218 fills the joint space between the two panels 217 and covers and secures the joint tab 214 to the two panels 217.

Figure 22:
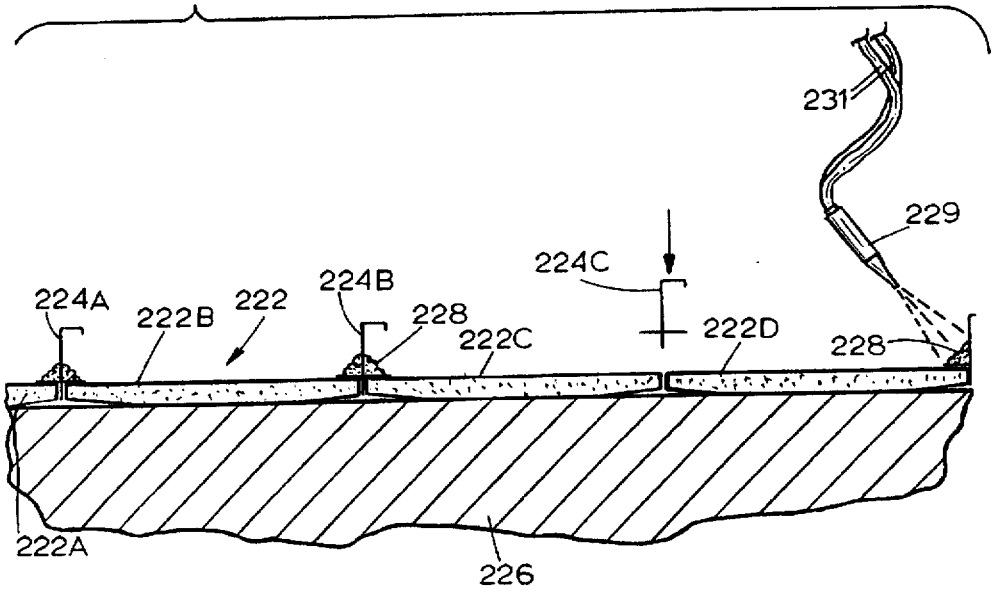
FIGS. 22 and 23 are views of a wall including the framing member shown in FIGS. 16 and 17 and illustrate a method of assembling the wall.
Figure 23:
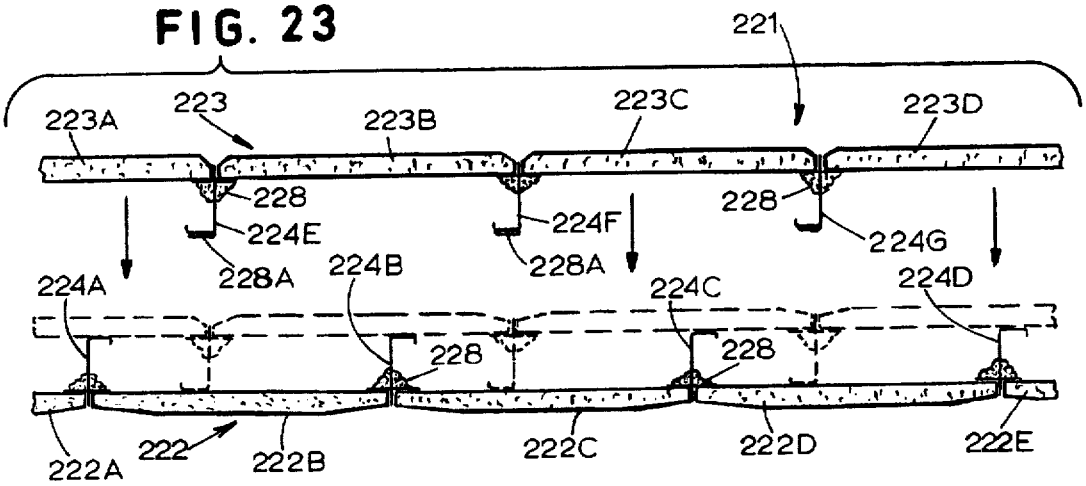
Figure 24:
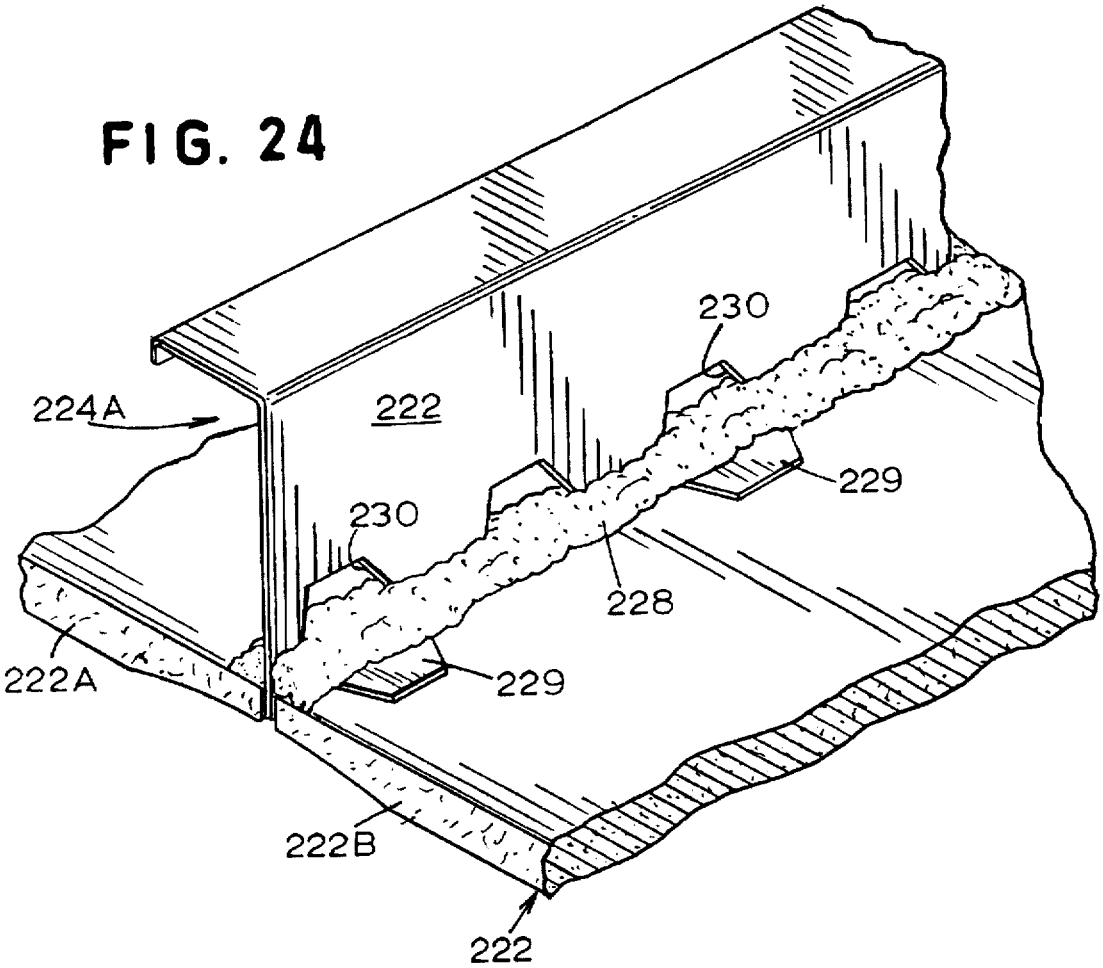
FIGS. 24 and 25 further illustrate the wall shown in FIGS. 22 and 23.
Figure 25:
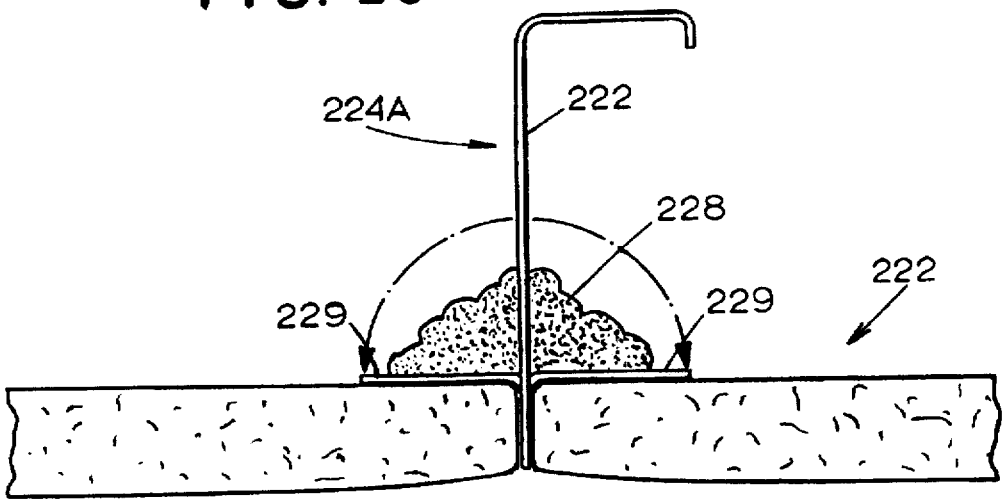
Figure 26:
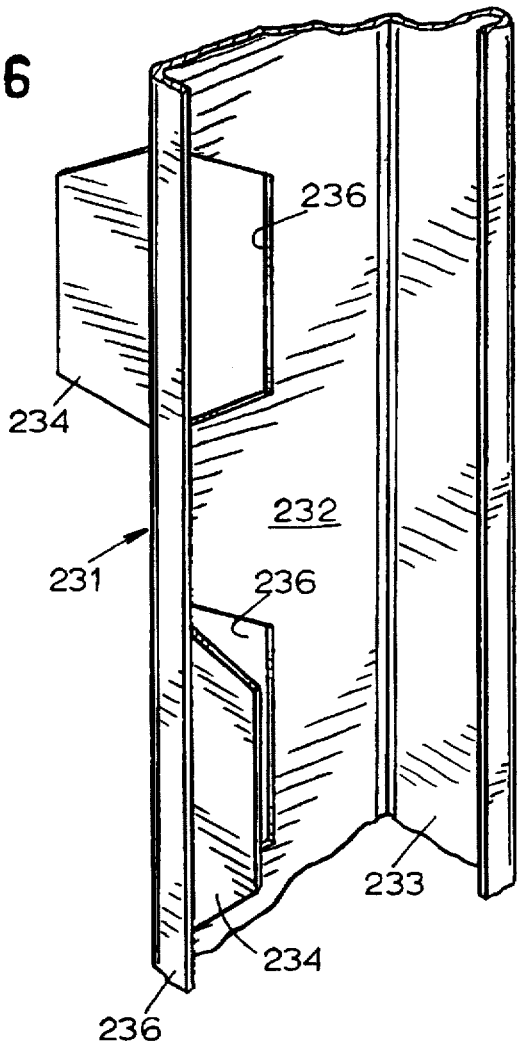
FIG. 26 is a perspective view showing another embodiment of the framing member.
Figure 27:
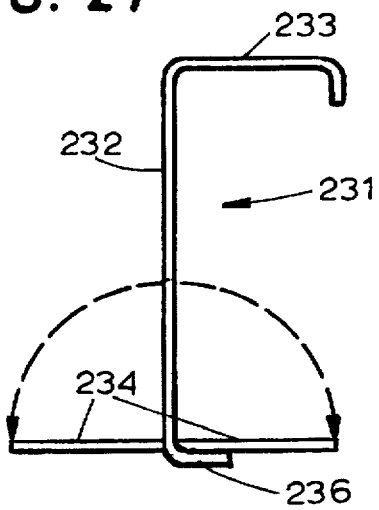
FIG. 27 is an end view of the framing member shown in FIG. 26.

FIGS. 22, 23, 24 and 25 illustrate a process for assembling a wall 221, which is particularly suited for the construction of manufactured housing. The wall is formed by an inner panel 222, an outer panel 223, and a plurality of framing members 224A to 224G (FIGS. 22 and 23) connecting the inner and outer panels. All of the framing members 224A through 224G are identical, and FIGS. 24 and 25 illustrate in greater detail the structure of the framing member 224A. In this instance the members 224A to 224G are identical with the framing member 201 illustrated in FIGS. 16 and 17.

As mentioned above, the method of constructing a wall is advantageous in the construction of manufactured housing wherein the wall may be assembled in a factory. With reference to FIGS. 22 and 23, the wallboard panels 222A through 222E are placed on a support such as a factory floor 226 with their adjacent edges close to one another. Framing members 224A through 224D are then inserted into and over the joints 227 between adjacent panels as best shown in FIG. 25, and then an adhesive 228, such as a foam adhesive, is applied to secure the framing members 224A through 224D to the panels 222A to 222E. In the example illustrated, the adhesive 228 is applied by a nozzle 229 which receives and mixes compounds received from hoses 231. As illustrated in FIGS. 24 and 25, the foam adhesive 228 extends over the back tabs 229, into the cutout openings 230 formed through the webs of the framing members, and over the outer sides of the panels adjacent the framing members.

In addition, the outer wall panel 223 (see FIG. 23) is similarly assembled by placing the panels 223A through 223D on a flat support surface, inserting the framing members 224E through 224G into the joints between adjacent panels, and applying the foam adhesive 228.

After the adhesive 228 has set, one of the two panels (in this example it is the panel 22) is moved and positioned against the outer side of the other of the two panels as illustrated by the dashed lines in FIG. 23. The joints and the framing members of one of the two panels are offset relative to those of the other of the panels so that the outer flanges of the framing members engage a center area of a panel of the opposing wall panel. Before moving the outer and inner wall panels 222 and 223 together, an adhesive 228A is applied to the outer sides of the outer flanges so that they adhere rigidly to the center areas of the other panels when assembled. After the adhesive set or cured, a joint compound (as illustrated in FIG. 18, for example) is applied to the joints between adjacent panels in order to complete the wall assembly.

FIGS. 26, 27, 28 and 29 illustrate another embodiment of the framing member 231 which includes a web 232, an outer flange 233 and oppositely extending back tabs 234 which are punched out in opposite directions from the web 232 and leave web openings 235. Another edge tab 236 is bent to extend parallel to the back tabs 234 and it extends closely adjacent to and under the back tabs extending in one of the directions, as shown, for example, in FIG. 27. The tab 236 extends between and joins the spaces between the tabs 234 and the openings 235, thus strengthening the inner side of the framing member. By being bent at an angle to the web 232, the tab 236 also stiffens the web. The framing member 231 is advantageous in that it may be secured to a panel or panels at a joint or anywhere along the backside of a panel.

Figure 28:
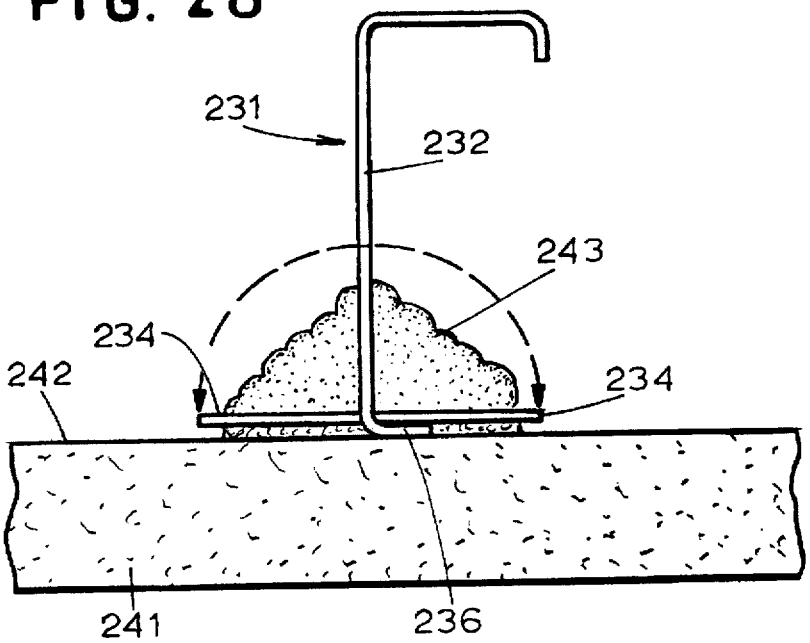
FIGS. 28 and 29 show sectional views of walls and the framing member illustrated in FIGS. 26 and 27.
Figure 29:
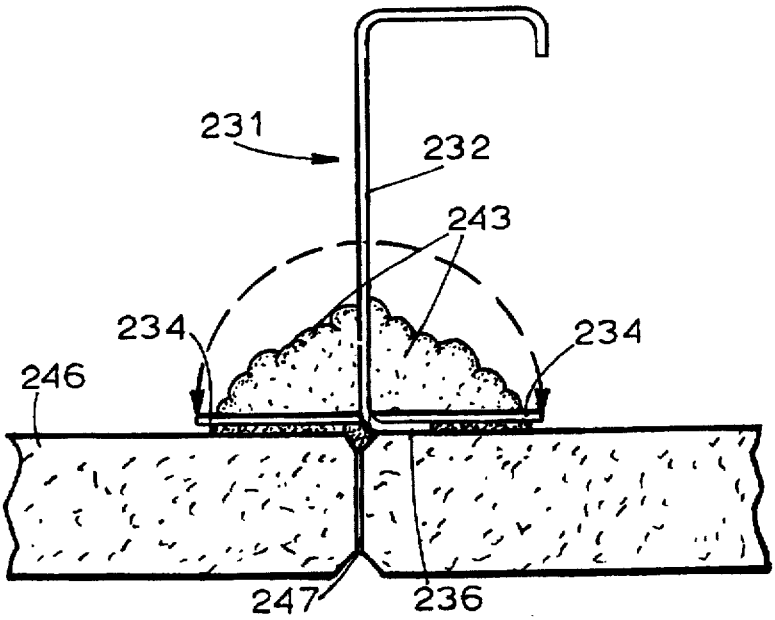
Figure 30:
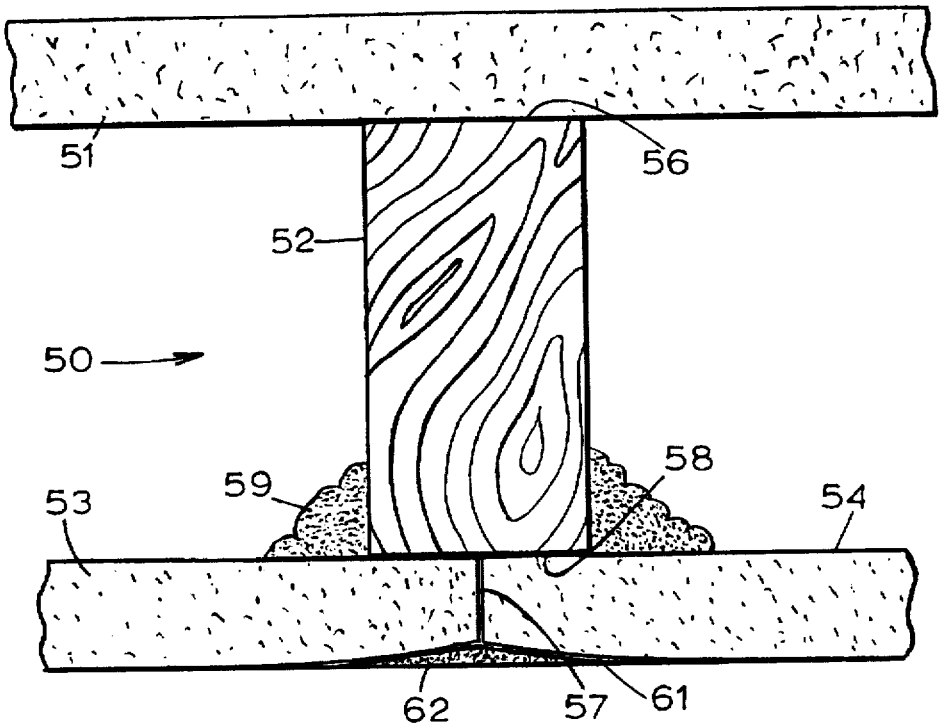
FIG. 30 PRIOR ART
FIG. 30 is a sectional view of a wall constructed in accordance with the prior art.
Figure 31:
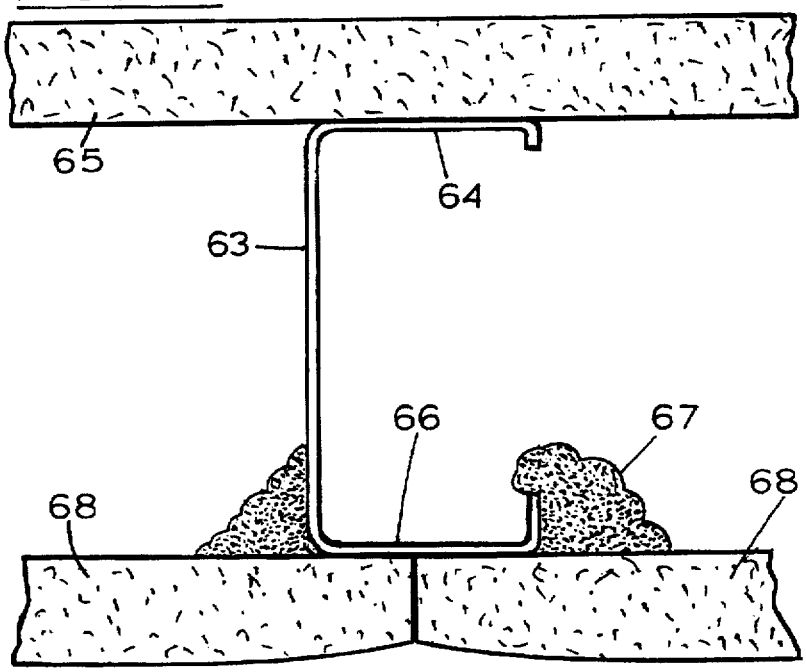
FIG. 31 PRIOR ART
FIG. 31 is a sectional view illustrating another prior art construction of a wall.

With reference to FIG. 28, to assemble a framing member 231 with the center area of a panel 241, the framing member is positioned with the tab 236 against the outer surface 242 of the panel 241. The back tabs 234 are thereby spaced a short distance from the surface 242 by the thickness of the tab 236. An adhesive 243 is then applied over and around the tabs 234 and 236 and onto the surface 242 of the panel 241 in the areas between the tabs 234. The adhesive 243 also flows into the space underneath the tabs 234 and the surface 242 and through the openings 236, thereby firmly securing the framing member 231 to the panel 241.

When securing the framing member 231 to two panels 246 (see FIG. 29) forming a joint 247 between them, the framing member 231 is positioned on the outer sides of the two panels 246 with the web 232 generally aligned with the joint 247. The adhesive 243 is then applied over and around the tabs 234, through the openings 236, and over the adjacent edge portions of the two panels 246, thereby securing the framing member to the two panels. A joint compound (not shown) is later applied to the joint 247. The arrangement shown in FIG. 29 has the advantage that the joint 247 is quite small due to the absence of a joint tab between them.

The foam adhesive 228 and 243 may be a conventional commercially available product such as Foamseal 2100 which is marketed by the Foamseal Company. It is believed to be a polyurethane adhesive. The joint compound, such as the compound 107, may be a conventional commercially available high strength, quick setting type such as the Sta-Smooth HS30 joint compound marketed by National Gypsum Company. An epoxy adhesive may also be used.

It will be apparent from the foregoing that a novel and useful wall and method of assembly has been provided, as well as a structural member for use in the wall. The wall panels and the structural members may be readily and economically assembled, and the structural members require less metal than conventional structural members for this purpose. The wall may be quickly assembled in a factory, particularly when a fast setting type of foam adhesive and/or joint compound is used. In the construction of manufactured housing, which is usually towed on a highway to a parking site, a high strength type of foam adhesive and/or joint compound is used, which will withstand the stresses encountered when the housing is moved.

What is claimed is:

1. A wall comprising an inner panel and an outer panel, said inner and outer panels being substantially parallel and spaced apart to form a space therebetween, at least one framing member within said space and extending between said inner and outer panels, said framing member including an outer portion engaging said outer panel, an inner portion engaging said inner panel, and a web portion connecting said outer and inner portions, and a plurality of back tabs extending from said web portion, said back tabs being formed from said web portion and leaving a plurality of openings in said web portion, said inner panel having a front side and a back side and said back tabs extending adjacent said back side, said back tabs being spaced apart and said openings being spaced apart, said inner portion including at least one edge tab, said edge tab joining said inner portion across said openings, first means for adhesively securing said inner portion to said inner panel, and second means for securing said outer portion to said outer panel.

2. A wall as set forth in claim 1, wherein said second means comprises an adhesive.

3. A wall as set forth in claim 2, wherein said second means comprises a foam adhesive.

4. A wall as set forth in claim 1, wherein said first means extends into said openings.

5. A wall as set forth in claim 1, wherein said inner portion is integrally formed with said web.

6. A wall as set forth in claim 5, wherein said back tabs are punched out of said web portion.

7. A wall as set forth in claim 6, wherein said punched out back tabs form said openings in said web, and said first means extends through said openings and across said back tabs and said back side of said inner panel.

8. A wall as set forth in claim 7, and further including a clip including front and back flanges and a clip web connecting said front and back flanges, said back flange extending through one of said openings in said web portion of said framing member, and said front flange being on said front side of said inner panel.

9. A wall as set forth in claim 8, wherein at least one of said flanges of said clip includes a slanted portion which slants away from said inner panel.

10. A wall as set forth in claim 8, wherein said inner panel includes first and second adjacent boards which form a joint therebetween and wherein said front flange of said clip includes first and second tabs, said first tab being disposed against said first board and said second tab being disposed against said second board.

11. A wall as set forth in claim 1, wherein said first means comprises a high strength joint compound.

12. A wall as set forth in claim 1, wherein said first means comprises a foam adhesive.

13. A wall as set forth in claim 1, wherein said openings are located in said web portion between said back tabs and said outer portion.

14. A wall comprising an inner panel and an outer panel, said inner and outer panels being substantially parallel and spaced apart to form a space therebetween, at least one framing member within said space and extending between said inner and outer panels, said framing member including an outer portion engaging said outer panel and an inner portion engaging said inner panel, said inner portion including at least one tab, first means for adhesively securing said inner portion to said inner panel, and second means for securing said outer portion to said outer panel, said inner panel including adjacent boards which form a joint therebetween, said at least one tab extending into said joint, said at least one tab including a rough surface engaging said first means.

15. A wall as set forth in claim 14, wherein said first means comprises a high strength joint compound which extends into said joint and engages said at least one tab.

16. A wall as set forth in claim 14, wherein said adjacent boards include front and back surfaces and a plurality of said tabs are provided including front tabs on said front surface and back tabs on said back surface.

17. A wall as set forth in claim 14, wherein said tab has sharp points formed thereon, said points extending from said tab and into said adjacent boards in said joint.

18. A method of assembling a wall including inner and outer panels and at least one framing member, comprising the steps of forming said framing member with a web having an edge tab along one edge thereof, forming a plurality of spaced apart back tabs by punching said back tabs from said web and leaving openings in said web, said back tabs extending perpendicularly of said web, positioning said framing member with said web perpendicular of said inner panel and said back tabs closely adjacent said inner panel, applying an adhesive compound on said tabs and said inner panel to secure said framing member to said inner panel, positioning said outer panel parallel with said inner panel and closely adjacent said framing member, and securing said outer panel to said framing member.

19. A method as set forth in claim 18, wherein said outer panel is secured to said inner panel with an adhesive.

20. A method as set forth in claim 18, and further including the steps of attaching a clip between said inner panel and said framing member, and securing said clip to said inner panel with said adhesive.

21. A framing member for use in a wall including inner and outer panels which are spaced apart and form a space therebetween, said framing member comprising a formed sheet metal member including an elongated web operable to extend substantially perpendicular to said panels and across said space, an outer portion formed on said web and operable to be secured to said outer panel, and an inner portion formed on said web and operable to be secured to said inner panel, said inner portion comprising a plurality of back tabs punched from said web and leaving punch-out openings in said web, said back tabs and said openings being spaced apart along said elongated web and said openings being between said back tabs and said outer portion, some of said back tabs extending in one direction laterally of said web and the remainder of said back tabs extending in the opposite direction laterally of said web, and an additional tab extending between said plurality of back tabs and across said openings, said additional tab having a rough surface.

22. A framing member as set forth in claim 21, wherein said additional tab extends substantially parallel with said web and perpendicular of said back tabs.

23. A framing member as set forth in claim 21, wherein said additional tab is in substantially the same plane as said web and said back tabs extend laterally and alternately in opposite directions from said plane.

24. A framing member as set forth in claim 23, wherein said back tabs are between said additional tab and said punch-out openings.

25. The framing member of claim 21 wherein said additional tab extends substantially along a length of the web.

26. A wall comprising an inner panel and an outer panel, said inner and outer panels being substantially parallel and spaced apart to form a space therebetween, at least one framing member within said space and extending between said inner and outer panels, said framing member including an outer portion engaging said outer panel and an inner portion engaging said inner panel, said inner portion including at least one tab, first means for adhesively securing said inner portion to said inner panel, and second means for securing said outer portion to said outer panel, said inner panel including adjacent boards which form a joint therebetween, said at least one tab extending into said joint, said at least one tab including a curved portion which engages said first means.

27. The wall of claim 26 wherein said first means comprises a high strength joint compound which extends into said joint and engages said at least one tab.

28. A framing member for use in a wall including inner and outer panels which are spaced apart and form a space therebetween, said framing member comprising a formed sheet metal member including an elongated web operable to extend substantially perpendicular to said panels and across said space, an outer portion formed on said web and operable to be secured to said outer panel, and an inner portion formed on said web and operable to be secured to said inner panel, said inner portion comprising a plurality of back tabs punched from said web and leaving punch-out openings in said web, said back tabs and said openings being spaced apart along said elongated web and said openings being between said back tabs and said outer portion, some of said back tabs extending in one direction laterally of said web and the remainder of said back tabs extending in the opposite direction laterally of said web, and an additional tab extending substantially along a length of the web and having a curved portion, the framing member terminating at said additional tab.

29. The framing member of claim 28 wherein said additional tab has at least a portion thereof in substantially the same plane as said web and said back tabs extend laterally and alternately in opposite directions from said plane.

30. The framing member of claim 28 wherein said additional tab has at least a portion thereof extending substantially parallel with said back tabs.

* * * * *